US008752938B2

(12) United States Patent
Miyazawa et al.

(10) Patent No.: US 8,752,938 B2
(45) **Date of Patent: *Jun. 17, 2014**

(54) LIQUID EJECTING HEAD AND LIQUID EJECTING APPARATUS

(75) Inventors: Hiromu Miyazawa, Azumino (JP); Hiroshi Ito, Suwa (JP); Jiro Kato, Suwa (JP); Eiju Hirai, Minamiminowa-mura (JP); Toshihiro Shimizu, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 85 days.

This patent is subject to a terminal disclaimer.

(21) Appl. No.: 12/974,800

(22) Filed: Dec. 21, 2010

(65) Prior Publication Data

US 2011/0148990 A1 Jun. 23, 2011

(30) Foreign Application Priority Data

Dec. 21, 2009 (JP) ..... 2009-289790

(51) Int. Cl.
*B41J 2/045* (2006.01)

(52) U.S. Cl.
USPC ..... 347/68; 347/70; 347/71

(58) Field of Classification Search
USPC ..... 347/20, 68, 70, 71
See application file for complete search history.

(56) References Cited

U.S. PATENT DOCUMENTS 6,309,055 B1 10/2001 Sakai et al.
6,502,928 B1 * 1/2003 Shimada et al. ..... 347/68
7,453,188 B2 11/2008 Matsuda et al.
2003/0222944 A1 12/2003 Matsuzawa
2008/0259133 A1 10/2008 Hara et al.
2009/0284568 A1 11/2009 Yazaki

FOREIGN PATENT DOCUMENTS

JP 2005-088441 4/2005
JP 2007-168141 7/2007
JP 2009-16625 1/2009
JP 2009-172878 8/2009

OTHER PUBLICATIONS

U.S. Appl. No. 12/974,851, filed Dec. 21, 2010, Miyazawa et al.
U.S. Appl. No. 12/974,851, Jun. 8, 2012, Office Action.

* cited by examiner

*Primary Examiner* — Jannelle M Lebron
(74) *Attorney, Agent, or Firm* — Workman Nydegger

(57) ABSTRACT

A liquid ejecting head includes a flow channel forming substrate having pressure generation chambers communicating with a nozzle opening and arranged in parallel along a lateral direction. A piezoelectric element is provided on one surface of the flow channel forming substrate in correspondence to the pressure generation chamber, and has a first electrode, a piezoelectric layer provided on the first electrode and a second electrode provided on the piezoelectric layer. In a direction intersecting with the arrangement direction of the pressure generation chambers, in boundaries between an active section that is a substantial driving section and an inactive section that is not a substantial driving section of the piezoelectric layer, the first electrode includes a taper section of which a width is gradually decreased toward the boundary from the active section side.

14 Claims, 9 Drawing Sheets

LIQUID EJECTING HEAD AND LIQUID EJECTING APPARATUS

CROSS-REFERENCE TO RELATED APPLICATIONS

This application claims the benefit of priority to Japanese Patent Application No. 2009-289790 filed Dec. 21, 2009, the contents of which are hereby incorporated by reference in their entirety.

BACKGROUND

1. Technical Field

The present invention relates to a liquid ejecting head and a liquid ejecting apparatus including a piezoelectric element.

2. Related Art

As a liquid ejecting head, here is an ink jet type recording head provided with piezoelectric elements that includes a first electrode, a piezoelectric layer and a second electrode on one surface of the flow channel forming substrate in which a pressure generation chamber linking with a nozzle opening is provided. The ink jet type recording head generates pressure change in the pressure generation chamber by means of a driving force of the piezoelectric elements so that ink droplets are ejected from the nozzle opening. There is a problem in that piezoelectric elements, which are used in such an ink jet type recording head, are easily broken due to the external environment, such as humidity or the like. In order to solve this problem, for example, the second electrode is configured to cover the outer circumferential surface of the piezoelectric layer (for example, see JP-A-2005-88441). The first electrode is a common electrode and the second electrode is an individual electrode in JP-A-2005-88441.

Also, an ink jet type recording head is suggested wherein a first electrode of the piezoelectric element is provided in each of the pressure generation chambers as an individual electrode and a second electrode is continuously provided in a plurality of pressure generation chambers as a common electrode (for example, see FIGS. 2 and 4 of JP-A-2009-172878). According to the configuration, the second electrode itself serves as a protective film of a surface section of the piezoelectric layer so that there is no necessity to separately provide a protective film.

In the piezoelectric element in which the second electrode is the common electrode as shown in FIGS. 2 and 4 of JP-A-2009-172878, for example, in a piezoelectric body section in which one of the upper and lower side electrodes is not present, because there is no electron supply source (electrode) that shields a polarization electric charge that is induced on a piezoelectric body surface by a stress deformation, an instance of insulation damage or cracking readily occurs due to the induced polarization electric charge.

The above-described problem is present not only in the ink jet type recording head but also in the liquid ejecting head ejecting liquids other than ink.

SUMMARY

An advantage of some aspects of the invention is that it provides a liquid ejecting head and a liquid ejecting apparatus capable of preventing piezoelectric elements from being broken.

According to an aspect of the invention, a liquid ejecting head includes a flow channel forming substrate having a pressure generation chamber that is linked with a nozzle opening and are arranged in parallel along a lateral direction;

and a piezoelectric element that is provided on one surface of the flow channel forming substrate in correspondence to the pressure generation chamber, and has a first electrode, a piezoelectric layer that is provided on the first electrode and a second electrode that is provided on the piezoelectric layer, wherein the first electrode is independently provided in correspondence to the pressure generation chamber, and the second electrode is continuously provided along the arrangement direction of the pressure generation chamber, and wherein in an direction intersecting with the arrangement direction of the pressure generation chamber, in at least one of boundaries between an active section that is a substantial driving section and an inactive section that is not a substantial driving section of the piezoelectric layer, the first electrode includes a taper section of which a width is gradually decreased toward the boundary from the active section side.

In this aspect, the taper section, of which the width is gradually decreased toward the active section and the inactive section of the piezoelectric element, is provided. Therefore, an area to which an electric field of the first electrode per unit area of the piezoelectric layer is applied can be gradually decreased toward the boundary, and a stress concentration toward the boundary between the active section and the inactive section can be decreased so that the piezoelectric element can be reliably prevented from being broken.

According to the aspect of the invention, it is preferable that the taper section is provided such that the width thereof is gradually decreased in the active section and the inactive section. Accordingly, the taper section is provided to the inactive section, and a boundary between an area where the first electrode (taper section) is present and an area where the first electrode is not present, in which a stiffness is rapidly changed, and a boundary between the active section and the inactive section can be deviated, so that a stress concentration toward the boundary between the active section and the inactive section can be decreased and the piezoelectric element can be prevented from being broken.

According to the aspect of the invention, it is preferable that the side surface of the taper section is provided to form an angle of 45° or less with respect to the side surface of a straight-line section of a center portion of the first electrode. Accordingly, the stress concentration toward the boundary between the active section and the inactive section can be reliably decreased by the taper section having a predetermined angle.

According to the aspect of the invention, it is preferable that in the direction intersecting with the arrangement direction of the pressure generation chamber, an extending section extends to the outside of the piezoelectric layer at one end portion side of the first electrode, and the taper section is provided in at least one boundary opposite to the extending section of boundaries between the active section and the inactive section of the piezoelectric layer. Accordingly, in the extending section of the boundary between the active section and the inactive section of the piezoelectric element, the stiffness is not rapidly changed by the extending section so that breakage of the piezoelectric element is more difficult compared to the opposite side of the extending section. The taper section is provided such that the width thereof is gradually decreased toward the boundary opposite to the extending section that is easily broken so that the stress in the area that is easily broken can be reliably prevented from being concentrated.

According to the aspect of the invention, it is preferable that the taper section is also provided in the boundary of the extending section side of the boundaries between the active section and the inactive section of the piezoelectric layer.

Accordingly, the boundary of the extending section side that is difficult to break can be further reliably prevented from being broken.

According to the aspect of the invention, it is preferable that the taper section is provided so as to be symmetrical in the longitudinal direction at the area in which the active section is formed. Accordingly, the taper section can be easily formed, dispersion of the stress can be prevented from being deviated, and thus stable displacement can be obtained.

According to the aspect of the invention, it is preferable that an area, at which the width is narrower than that of the straight-line section, which is provided on the center portion of the first electrode of the extending section, have a thickness thicker than that of the straight-line section. Accordingly, an electrical resistance of the area of which the width is narrowed, is lowered and the voltage drop can be prevented.

According to an aspect of the invention, a liquid ejecting apparatus includes the liquid ejecting head according to the above descriptions.

In this aspect, a liquid ejecting apparatus having improved reliability and durability can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

First Embodiment

Figure 1:
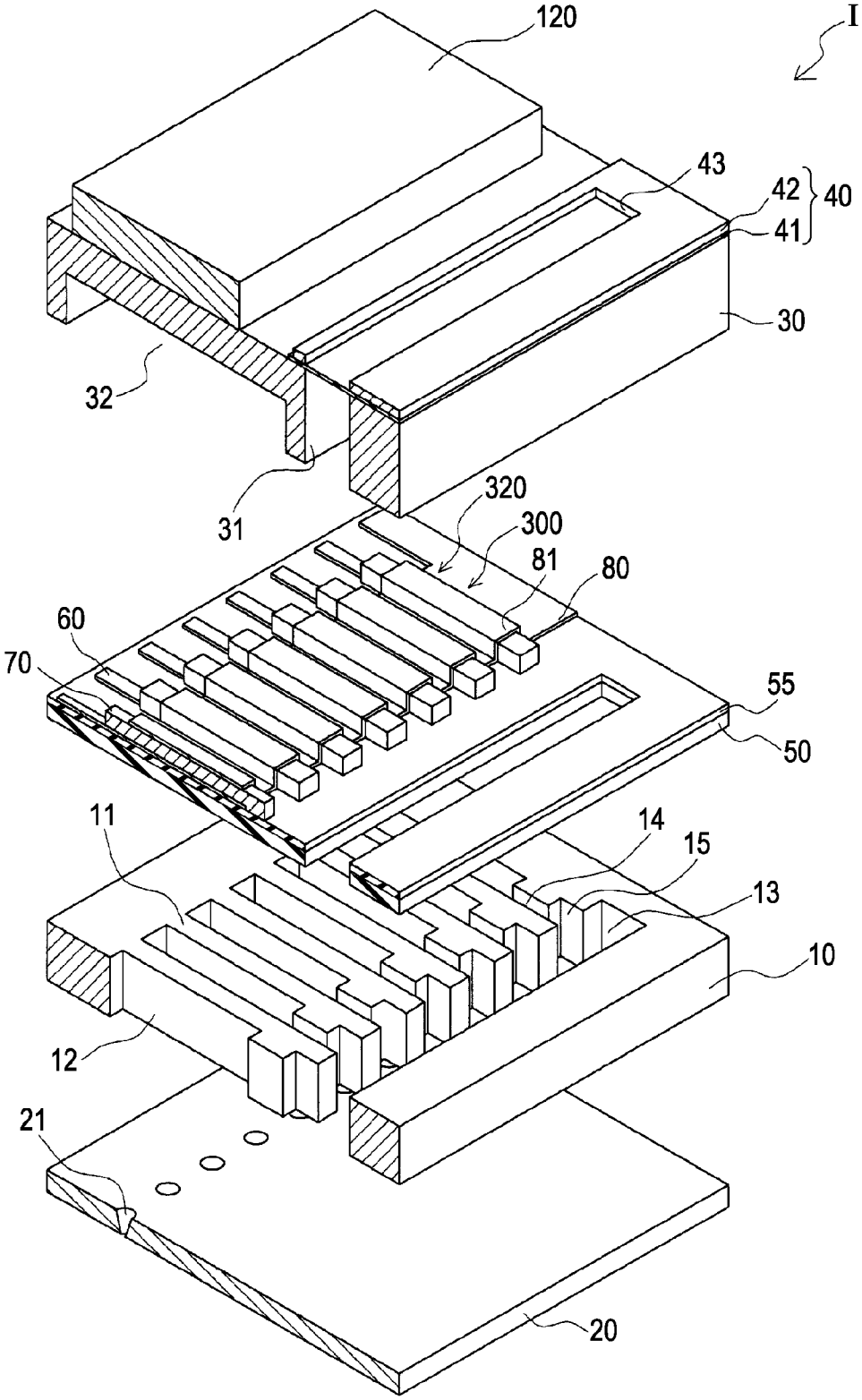
FIG. 1 is an exploded perspective view of a recording head according to a first embodiment.
Figure 2A:
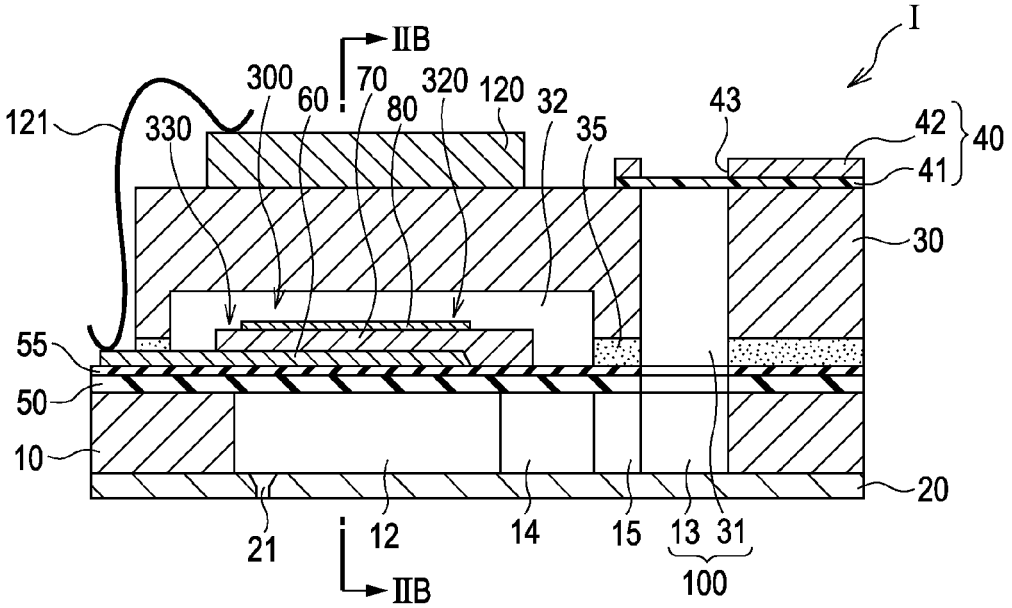
FIGS. 2A and 2B are sectional views of the recording head according to the first embodiment.
Figure 2B:
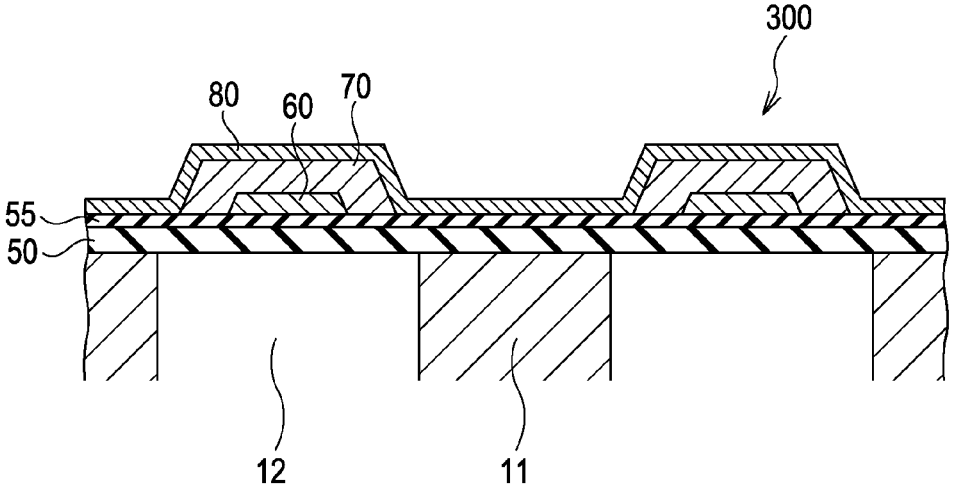

FIG. 1 is an exploded perspective view of an ink jet type recording head, that is an example of a liquid ejecting head according to a first embodiment of the invention, FIG. 2A is a sectional view of the ink jet type recording head and FIG. 2B is a sectional view taken along the line IIB-IIB of FIG. 2A.

As shown in drawings, in this embodiment, a flow channel forming substrate 10 is made of a silicon monocrystal substrate, and an elastic film 50 made of silicon dioxide is formed on one surface thereof.

In the flow channel forming substrate 10, a plurality of pressure generation chambers 12 are arranged in parallel in a width direction thereof. Also, a linking section 13 is formed in an area outside in a longitudinal direction of the pressure generation chamber 12 of the flow channel forming substrate 10, and the linking section 13 and each of the plurality of pressure generation chambers 12 is linked through an ink supply channel 14 and a linking channel 15 which are provided on each of the plurality of pressure generation chambers 12. The linking section 13 is linked with a manifold section 31 of a protective substrate that will be described below, and constitutes a part of the manifold serving as a common ink chamber of each of the pressure generation chambers 12. The ink supply channel 14 is formed to have a width smaller than that of the pressure generation chamber 12, and constantly maintains flow channel resistance of ink flowing into the pressure generation chamber 12 from the linking section 13. In addition, in this embodiment, the ink supply channel 14 is formed by narrowing a width of the flow channel on one side, but the ink supply channel may be formed by narrowing the width of the flow channel on both sides. Alternatively, the ink supply channel may be formed by narrowing in a thickness direction, instead of by narrowing the width of the flow channel.

Also, in the embodiment, a liquid flow channel that is formed by the pressure generation chamber 12, the linking section 13, the ink supply channel 14 and the linking channel 15 is provided on the flow channel forming substrate 10.

A nozzle plate 20 is fixed onto an opening surface side of the flow channel forming substrate 10 by an adhesive, a thermally welding film or the like. The nozzle plate 20 is provided with nozzle opening 21, each of the nozzle openings linking with a vicinity of an end portion of the pressure generation chamber 12 opposite to the ink supply channel 14. The nozzle plate 20 is made of, for example, glass ceramics, a silicon monocrystal substrate, stainless steel, or the like.

The elastic film 50 is formed on a side opposite to the opening surface of the flow channel forming substrate 10 as described above and an insulator film 55 is formed on the elastic film 50. A piezoelectric element 300 having a first electrode 60, a piezoelectric layer 70 and a second electrode 80 which are laminated, is formed on the insulator film 55. The piezoelectric element 300 is a portion that includes the first electrode 60, the piezoelectric layer 70 and a second electrode 80. In general, one electrode of piezoelectric element 300 serves as a common electrode, and the other electrode and the piezoelectric layer 70 are patterned for each of pressure generation chambers 12. Thus, in an area that is sandwiched by two electrodes of the piezoelectric layer 70, a portion in which a piezoelectric distortion is generated by applying voltage to both electrodes is an active section 320. In the embodiment, the first electrode 60 serves as an individual electrode of the piezoelectric element 300 by providing the first electrode 60 to each of pressure generation chambers 12 and the second electrode 80 serves as a common electrode by providing the second electrode 80 in the plurality of pressure generation chambers 12. In other words, a substantially driving area that is sandwiched between the first electrode 60 and the second electrode 80 of the piezoelectric layer 70 is an active section 320 and a substantially non-driving area is an inactive section 330 in which one or both of electrodes 60 and 80 of the piezoelectric layer 70 are not provided. Also, an apparatus having the piezoelectric element 300, which is displaceable, is called an actuator apparatus. In the above example, the elastic film 50, an insulator film 55 and the first electrode 60 serve as a vibration plate, but the invention is, of course, not limited thereto and for example, alternatively only the first electrode 60 may be made as a vibration plate while the elastic film 50 and the insulator film 55 are not provided. In addition, the piezoelectric element 300 itself may substantially serve as a vibration plate.

The structure of the piezoelectric element 300 will be described in detail, referring to FIGS. 3A, 3B, and 4.

Figure 3A:
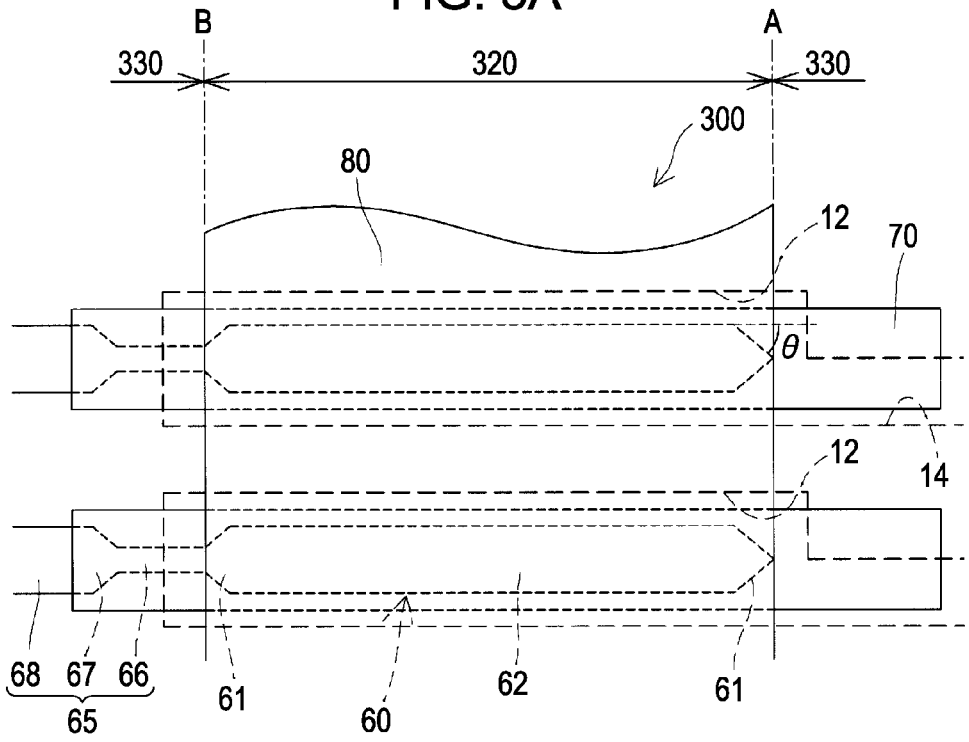
FIGS. 3A and 3B are a plan view and an enlarged sectional view of main parts of the recording head according to the first embodiment.
Figure 3B:
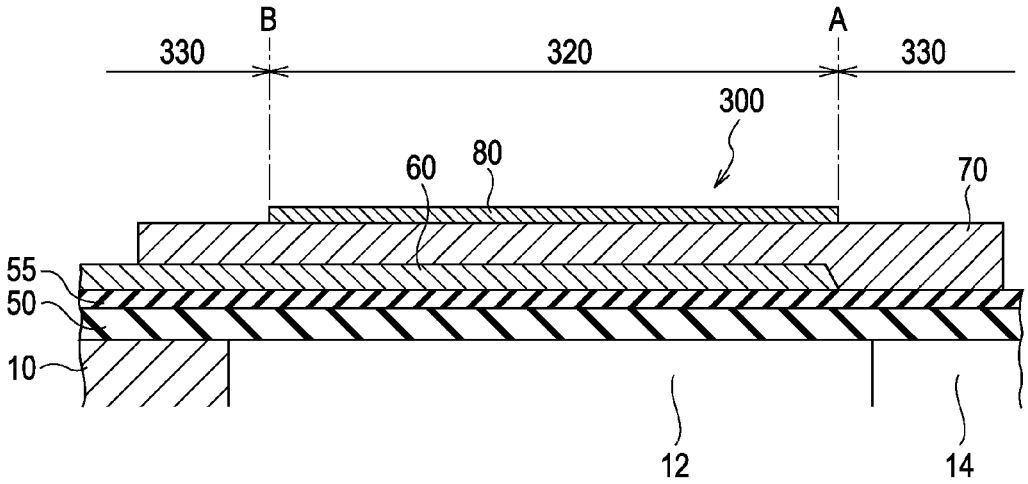
Figure 4:
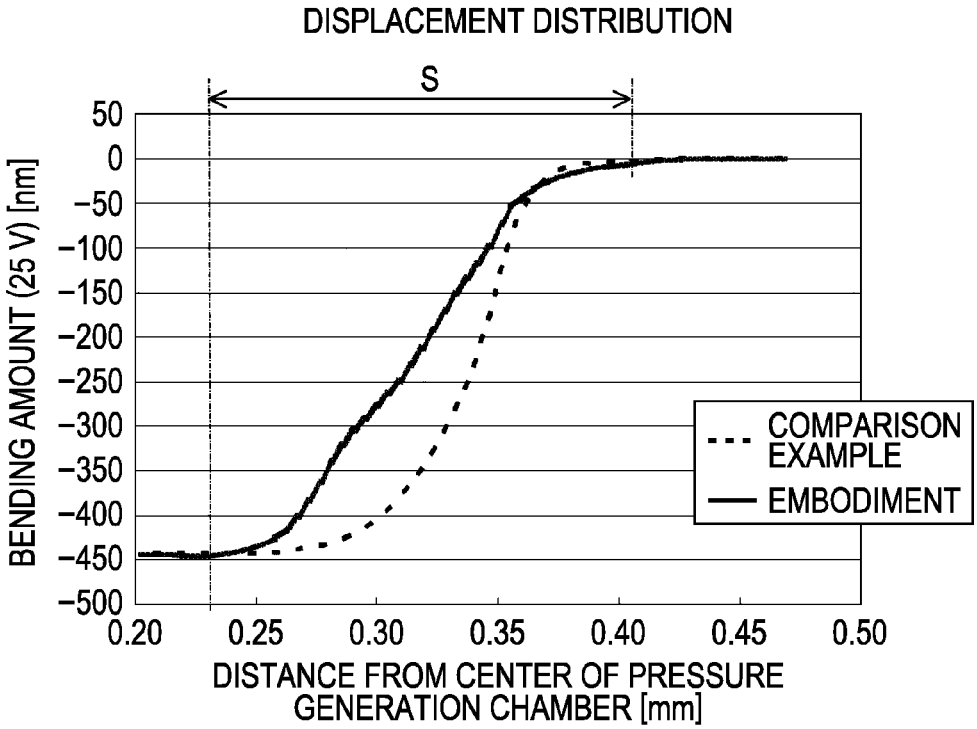
FIG. 4 is a graph showing an analysis result according to the first embodiment.

As shown in FIGS. 3A, 3B, and 4, the first electrode 60 constituting the piezoelectric element 300 is independently provided in correspondence to each of pressure generation chambers 12. Now, independently providing the first electrode 60 in correspondence to each of pressure generation chambers 12 means the first electrode 60 is separated so as to be discontinuous in the arrangement direction of the pressure generation chamber 12. In the embodiment, the first electrode 60 is provided with a width narrower than that (a width of the pressure generation chamber 12 in the arrangement direction) of a lateral direction of the pressure generation chamber 12 and thus the first electrode 60 is independently provided in correspondence to each of the pressure generation chambers 12.

The first electrodes 60 which are individually provided on each of the pressure generation chambers 12 are not electrically connected so as to function as an independent electrode of the piezoelectric element 300 by themselves.

Furthermore, in an opposite end portion of the ink supply channel 14 of the first electrode 60, an extending section 65 is extended to further outside the end portion of the piezoelectric layer 70 in the longitudinal direction of the pressure generation chamber 12. The end portion of the extending section 65 is exposed without being covered with the piezoelectric layer 70 so that it becomes a connection terminal electrically connected to a driving circuit 120 that will be described below in detail. In other words, the first electrode 60 is drawn out from the piezoelectric element 300 and thus also functions as a drawn-out wiring to which the driving circuit 120 is connected. Of course, an electrically conductive wiring that is different from the first electrode 60 may be separately provided as the drawn-out wiring.

An end portion of the ink supply channel 14 side of the first electrode 60, in other words, an end portion of the side opposite to the extending section 65 is arranged so as to become an inside of the pressure generation chamber 12 side. In the embodiment, the end portion of the ink supply channel 14 side of the first electrode 60 is provided so as to be at the same position as that of the end portion of the second electrode 80. Accordingly, the first electrode 60 defines the width of the lateral direction (the arrangement direction of the pressure generation chamber 12) of the active section 320, and the second electrode 80 defines a length of the longitudinal direction (an direction intersecting with the arrangement direction of the pressure generation chamber 12) of the active section 320. In the embodiment, because the end portion of the ink supply channel 14 side of the first electrode 60 is provided so as to be at the same position as that of the second electrode 80, the first electrode 60 may also define one end portion of the longitudinal direction of the active section 320.

In the direction (the longitudinal direction of the pressure generation chamber 12) intersecting with the arrangement direction of the pressure generation chamber 12, a taper section 61 is provided at one side boundary A of both boundaries A and B between the active section 320 and the inactive section 330 of the first electrode 60, wherein the width of the taper section 61 is gradually decreased toward the boundary A in the area facing the active section 320. In other words, the first electrode 60 has a straight-line section 62 that is formed having the substantially same width at a center portion of the longitudinal direction of the pressure generation chamber 12, and a taper section 61 that has a width that is gradually decreased continues to the straight-line section 62. In the embodiment, the taper section 61 is provided at the boundary A of the ink supply channel 14 side of the first electrode 60. Thus, the end portion of the taper section 61 becomes the end portion (the boundary A) of the ink supply channel 14 side of the active section 320 of the piezoelectric layer 70.

In the embodiment, a taper section 61 is provided even in a boundary B between the active section 320 and the inactive section 330 of the side opposite to the ink supply channel 14 in a longitudinal direction of the pressure generation chamber 12, wherein the width of the taper section 61 is gradually decreased toward the boundary B in the active section 320. In the side opposite to the ink supply channel 14 of the first electrode 60, the extending section 65 that is extended to the outside of the piezoelectric layer 70, is provided. The extending section 65 has a narrow width section 66 having a width narrower than that of the central straight-line section 62 of the first electrode 60 continuous to the taper section 61, a gradual increasing section 67 that is continuously provided opposite to the taper section 61 in the narrow width section 66 and of which the width is gradually increased, and a drawn-out section 68 that is continuously provided to the gradual increasing section 67 and of which the width is substantially the same as that of the straight-line section 62. Thus, the end portion of the second electrode 80 comes to the boundary B between the taper section 61 and the narrow width section 66 which are provided in the extending section 65 side of the first electrode 60. The end portion of the second electrode 80 defines one end portion (the boundary B) of the longitudinal direction of the active section 320 in the longitudinal direction of the pressure generation chamber 12.

The two taper sections 61 are formed such that the degree θ of the side surface thereof is an angle of 45° or less in regard to the side surface of the straight-line section 62. In other words, the degree of tip end of the taper section 61 is an angle of 90° or less. As described above, the degree of the taper section 61 is defined, so that a gradual decreasing rate of an area that applies an electric field to the piezoelectric layer 70 toward the boundary between the active section 320 and the inactive section 330 can be set to a suitable value, the stress concentration to the boundary between the active section 320 and the inactive section 330 can reliably be decreased, and risk of cracking due to the stress concentration can be suppressed.

In the embodiment, the piezoelectric layer 70 is independently provided in correspondence to the pressure generation chamber 12. In other words, the piezoelectric layer 70 that is provided in each of pressure generation chambers 12 is separately provided in each of the pressure generation chambers 12 so as to discontinuous in the arrangement direction of the pressure generation chamber 12.

The piezoelectric layer 70 is provided such that the width thereof is wider than that of the first electrode 60 in the lateral direction (the arrangement direction of the pressure generation chamber 12) of the pressure generation chamber 12 and narrower than that of the pressure generation chamber 12 in the lateral direction, and the piezoelectric layer 70 covers the end surface of the first electrode 60 in the width direction.

The piezoelectric layer 70 is provided to be longer than the pressure generation chamber 12 in the longitudinal direction (the direction intersecting with the arrangement direction of the pressure generation section 12) of the pressure generation section 12. In the embodiment, the piezoelectric layer 70 is provided in a size that covers the end portion of the ink supply channel 14 side of the first electrode 60 in the longitudinal direction of the pressure generation chamber 12.

The piezoelectric layer 70 is provided to be shorter than the end portion opposite to the linking section 13 of the first electrode 60 in the longitudinal direction of the pressure generation chamber 12 and a portion of the drawn-out wiring of the first electrode 60 is exposed. The driving circuit 120 is electrically connected to the exposed end portion of the first electrode 60.

The piezoelectric layer 70 is made by an piezoelectric material indicating an electric-mechanical conversion action for example, a ferroelectric material including Zr or Ti as a metal having a parasite structure, a ferroelectric material such as lead zirconate titanate (PZT) or the like; or a material with an addition of a metal oxide of niobium oxide, nickel oxide, magnesium oxide or the like. Specifically, examples of the piezoelectric material include lead zirconate titanate ($Pb(Zr,Ti)O_3$), barium zirconate titanate($Ba(Zr,Ti)O_3$), lead lanthanum zirconate titanate ($(Pb,La)(Zr,Ti)O_3$) or lead magnesium niobate zirconium titanate ($Pb(Zr,Ti)(Mg,Nb)O_3$).

The thickness of the piezoelectric layer 70 is not specifically limited, but the thickness may be controlled to the extent that cracks do not occur in the manufacturing process and the thickness may be thickly formed to the extent that sufficient displacement characteristic is present. For example, the thickness of the piezoelectric layer 70 is formed in about 0.2 to 5 μm so that a preferable crystal structure can easily obtained. In the embodiment, the film thickness of the piezoelectric layer 70 is 1.2 μm so as to obtain optimal voltage characteristic.

A manufacturing method for the piezoelectric layer 70 is not limited specifically, and for example, a so-called sol that dissolves and disperses the organic metal compound in a solvent is coated and dried so as to form a gel, and calcinated at high temperature so that the piezoelectric layer 70 composed of the metal oxide is obtained, in other words, piezoelectric layer 70 can be obtained by so-called sol-gel method. Of course, the manufacturing method of the piezoelectric layer 70 is not limited to the sol-gel method, and for example, a MOD (Metal-Organic Decomposition) method, a sputtering method or the like can be also used.

In the embodiment, the piezoelectric layer 70 is independently provided in each of the pressure generation chambers 12. However, the invention is not limited to the description and for example, the piezoelectric layer 70 can be also be continuously provided in the plurality of pressure generation chambers 12. In the embodiment, the piezoelectric layer 70 is separately provided in each of pressure generation chambers 12 independently so that the piezoelectric layer 70 does not disturb the displacement of the piezoelectric element 300.

Figure 11:
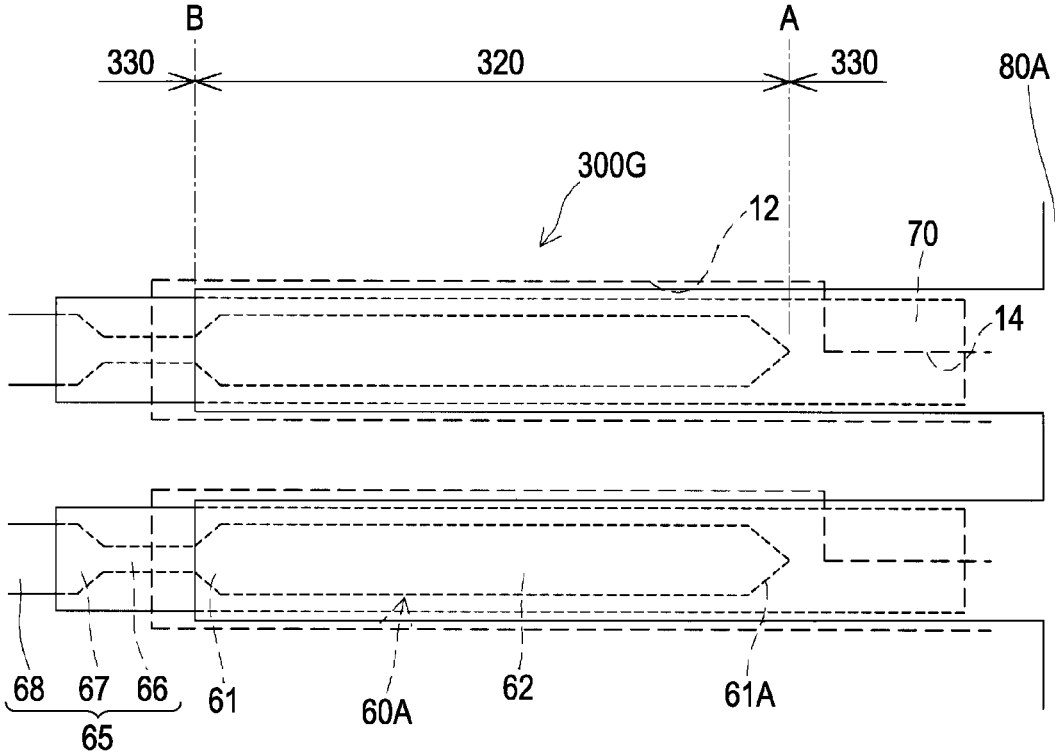
FIG. 11 is a plan view of a recording head according to another embodiment.

The second electrode 80 is continuously provided along the arrangement direction of the plurality of pressure generation chambers 12. The meaning that the second electrode 80 is continuously provided in the plurality of pressure generation chambers 12 includes the case where the second electrode 80 is continuously provided between adjacent pressure generation chambers 12 as shown in FIG. 3A, and the case where the second electrode 80 is provided in a so-called comb teeth shape, that is, the second electrode 80 is separated between the adjacent pressure generation chambers 12 and continuously provided in the outside between the adjacent pressure generation chambers 12, as shown in FIG. 11 described below.

In the longitudinal direction (the direction intersecting with the arrangement direction of the pressure generation chamber 12) of the pressure generation chamber 12, the second electrode 80 is provided within an area facing the pressure generation chamber 12. In other words, the end portion of the second electrode 80 in the longitudinal direction (the longitudinal direction of the pressure generation chamber 12) is provided so as to be positioned within the area of the pressure generation chamber 12.

In the extending section 65 side of the first electrode 60, the second electrode 80 is provided such that the end portion thereof is provided further inside than the first electrode 60, in other words, the end portion is positioned more toward the pressure generation chamber 12 side rather than the first electrode 60, and the end portion of the active section 320 of the piezoelectric layer 70 in the longitudinal direction is defined at the extending section 65 side.

In the piezoelectric element 300 that is constituted of the first electrode 60, the piezoelectric layer 70 and the second electrode 80, the end portion of the active section 320 that is substantially the driving section of the piezoelectric layer 70 in the lateral direction (width) is defined by the end portion of the width direction (the arrangement direction and the lateral direction of the pressure generation chamber 12) of the first electrode 60, and the end portion (length) of the active section 320 in the longitudinal direction is defined by the end portion of the second electrode 80 in the length direction(the longitudinal direction of the pressure generation chamber 12). Thus, another area of the piezoelectric layer 70, in other words, an area where one or both of the first electrode 60 and the second electrode 80 are not provided is an inactive section. Accordingly, the boundary between the active section 320 and the inactive section 330 is defined by the first electrode 60 and the second electrode 80.

As described above, in such the piezoelectric element 300, because the taper section 61 is provided on the end portion of the ink supply channel 14 side of the first electrode 60, the area of the first electrode 60 with respect to unit area of the piezoelectric layer 70 is gradually decreased by the taper section 61 toward boundaries A and B between the active section 320 and the inactive section 330 from the active section 320. Thus, an area that applies the electric field to the piezoelectric layer 70 is gradually decreased by the taper section 61 of the first electrode 60 toward boundaries A and B of the inactive section 330 from the active section 320. Because a displacement amount is changed in correspondence to the area to which the electric field is applied, the piezoelectric layer 70 gradually decreases the displacement amount toward boundaries A and B between the active section 320 and the inactive section 330 at the area in which the taper section 61 is provided. Specifically, in the case that the taper section 61 is not provided, when the piezoelectric element 300 is deformed, the stress concentration is generated at the boundaries A and B between the active section 320 and the inactive section 330. This means that one or both of the electrodes 60 and 80 are not provided, so that a difference in the stiffness of the piezoelectric element 300 is generated, the electric field is applied to the piezoelectric layer 70 of the active section 320 and the piezoelectric layer 70 is deformed. The electric field is not applied to the piezoelectric layer 70 of the inactive section 330 and the piezoelectric layer 70 is not deformed spontaneously (the deformation is followed by the deformation of the active section 320), so that the stress concentration occurs at the boundary between the active section 320 and the inactive section 330. However, in the embodiment, the taper section 61 is provided in the first electrode 60 such that the width of the taper section 61 is gradually decreased toward the inactive section 330 from the active section 320 so that the area to which the electric field is applied by the taper section 61 that is in the boundary between the active section 320 and the inactive section 330 can be gradually decreased toward the boundary. A force that deforms the piezoelectric layer 70 in the boundary between the active section 320 and the inactive section 330 is gradually decreased so that the displacement amount of the boundary end portion of the active section 320 can be decreased. As a result, a slope angle of the boundary portion is gentle when the piezoelectric element 300 is displaced, and the stress concentration of the boundary portion can be decreased. Thus, the risk of damage such as cracking at the boundaries A and B of the piezoelectric layer 70 and near area thereof can be suppressed.

In the inactive section 330 where the boundary A forms the boundary between the active section 320 and the inactive section 330, both the first electrode 60 and the second electrode 80 are not provided, and there is a large difference in stiffness between the active section 320 and the inactive section 330 at both sides of the boundary A. In regard to this, in the inactive section 330 where the boundary B forms the boundary between the active section 320 and the inactive section 330, because the first electrode 60 is provided by the extending section 65, the difference in stiffness of the active section 320 and the inactive section 330 on both sides of the boundary B is smaller than that for the boundary A. Thus, preferably the taper section 61 is provided at the boundary A in which at least the electrodes 60 and 80 are not provided at the inactive section 330. In the embodiment, the taper section 61 is also provided at the boundary B of the active section 320 in the extending section 65 side. In addition, in the extending section 65 side, because the first electrode 60 is provided by the extending section 65 to the inactive section 330 of the outside of the active section 320, the stiffness of the piezoelectric element 300 is not rapidly changed at the boundary between the active section 320 and the inactive section 330. However, the stress is concentrated by the deformation of the active section 320 at the boundary between the active section 320 and the inactive section 330. Thus, the taper section 61 is provided at the boundary between the active section 320 and the inactive section 330 in the extending section 65 side so that the stress concentration at the boundary B of the extending section 65 and the vicinity thereof is decreased and thus the risk of damage such as cracking or the like in the piezoelectric layer 70 can be suppressed.

In the embodiment, the taper section 61 is provided at the both boundaries A and B of the ink supply channel 14 side and the extending section 65 side. Accordingly, two taper sections 61 can be a substantially symmetrical structure in the longitudinal direction at the area, which becomes the active section 320.

In the case that the piezoelectric element 300 in which the taper section 61 of the above-described first embodiment is provided, is driven in 25V, a relationship between the displacement amount (bending amount) and the distance from the center of the pressure generation chamber 12 is calculated by simulation. Also, for comparison, the piezoelectric element 300 that is not provided with the taper section 61 in the first electrode 60 is set as a comparison example and in the case that the piezoelectric element 300 of the comparison example is driven in 25V the relationship between the displacement amount (bending amount) and the distance from the center of the pressure generation chamber 12 is calculated by simulation. FIG. 4 shows the results these simulations. Also FIG. 4 is a graph showing the result of the simulation, where the displacement amount of the piezoelectric element in the state where the voltage is not applied is set to 0 nm and the displacement toward the pressure generation chamber 12 side is indicated as a minus. The result of the simulation as shown in FIG. 4 is in the boundary A side.

As shown in FIG. 4, the piezoelectric element 300 of the embodiment in which the taper section 61 is provided and the piezoelectric element of the comparison example in which the taper section 61 is not provided indicate the same displacement amount in the center side of the pressure generation chamber 12, so that even in the case of piezoelectric element 300 of the embodiment, the ink ejection characteristic is not degraded due to the displacement of the piezoelectric element 300.

As shown in FIG. 4, in the piezoelectric element 300 in which the taper section 61 is not provided as in the comparison example, an angle of inclination of an area S between an area (the end portion of the pressure generation chamber 12 in the longitudinal direction, in which the displacement amount is 0) that is fixed on the flow channel forming substrate 10 of the piezoelectric element 300 and the center potion that is displaced so as to project to the inside of the pressure generation chamber 12 is formed rapidly (substantially vertically inclined). Meanwhile, in the piezoelectric element 300 of the embodiment in which the taper section 61 is provided, the angle of inclination of the area S is formed gently. Thus, the taper section 61 is provided in the first electrode 60 so that the inclination of the area S is formed gently, the stress concentration at the boundaries A and B between the active section 320 and the inactive section 330, and the vicinity thereof is suppressed. Thus, risk of damage such as cracking or the like can be suppressed. In addition, a range of the area S is defined by the boundaries A and B between the active section 320 and the inactive section 330 of the piezoelectric layer 70.

As shown in FIG. 2B, in the embodiment, the end surface of the first electrode 60 is provided to be inclined with respect to the thickness direction. As described above, there is a difference between the crystallization of the piezoelectric layer 70 in which the piezoelectric material is a crystal grown and formed on the inclined end surface, and the crystallization of the piezoelectric layer 70 in which the piezoelectric material is a crystal grown and formed on the horizontal surface (the straight-line section 62 or the like). Specifically, when the piezoelectric material is a crystal grown on the inclined surface, the crystal is grown to the vertical direction of the inclination surface and then is grown so as to deflect toward the vertical direction, so that the piezoelectric layer 70 having the crystallization inferior to that of the crystallization of the piezoelectric layer 70 that is formed on the horizontal surface, is formed. As described above, because the piezoelectric layer 70 having inferior crystallization is formed on the end surface of the taper section 61, the piezoelectric layer 70 on the taper section 61 has a voltage characteristic lower than that of the other area so that the displacement amount of the piezoelectric layer 70 on the taper section 61 is decreased and the stress concentration of the boundaries A and B between the active section 320 and the inactive section 330 can be decreased.

A protective substrate 30 having the manifold section 31 that constitutes at least a portion of a manifold 100, is bonded by adhesive 35 on the flow channel forming substrate 10 in which the piezoelectric element 300 is formed, in other words, on the first electrode 60 and the insulator film 55. In the embodiment, the manifold section 31 penetrates the protective substrate 30 along the thickness direction and is formed along the width direction of the pressure generation chamber 12. As described above, the manifold section 31 is linked with the linking section 13 of the flow channel forming substrate 10, so as to constitute the manifold 100 that is a common ink chamber of each of pressure generation chambers 12. Also, the linking section 13 of the flow channel forming substrate 10 may be divided in a plurality in each of pressure generation chambers 12 and then only the manifold section 31 may be provided as the manifold. Furthermore, for example, only the pressure generation chamber 12 is provided in the flow channel forming substrate 10 and the ink supply channel 14 that is linked with the manifold and each of pressure generation chambers 12 in intermediate members (for example, the elastic film 50, the insulator film 55 and the like) between the flow channel forming substrate 10 and the protective substrate 30 may be also provided.

In the area facing the piezoelectric element 300 of the protective substrate 30, a piezoelectric element holding section 32 occupies a space to the extent that does not hinder the movement of the piezoelectric element 300 is provided. The piezoelectric element holding section 32 may occupy the space to the extent that does not hinder the movement of the piezoelectric element 300, and the space may be sealed or, the space may not be sealed.

As the protective substrate 30, preferably, a material is used, such as glass or a ceramics having the same thermal expansion rate as that of the flow channel forming substrate 10. In the embodiment, a silicon monocrystal substrate that is the same material as the flow channel forming substrate 10 is used and then the protective substrate 30 is formed.

The driving circuit 120 for driving the piezoelectric elements 300 that are arranged in parallel is fixed on the protective substrate 30. As the driving circuit 120, for example, a circuit substrate or a semiconductor integrated circuit (IC) and the like can be used. Thus, the driving circuit 120, the first electrode 60 and the second electrode 80 are electrically connected through a connection wiring 121 including a conductive wire such as a bonding wire or the like.

Also, a compliance substrate 40 having a seal film 41 and a fixed plate 42 is bonded onto the protective substrate 30. The seal film 41 is made of a flexible material having low stiffness and one surface of the manifold section 31 is sealed by the seal film 41. Also, the fixed plate 42 is made of relatively hard material. An area of the fixed plate 42 opposite to the manifold 100 is an opening 43 that is completely penetrated in the thickness direction of the fixed plate 42 so that one surface of the manifold 100 is sealed only by the flexible seal film 41.

In the ink jet type recording head of the embodiment, ink is drawn from an ink introduction inlet connected to an external ink supply unit (not shown), and after ink is filled in the interior from the manifold 100 to the nozzle opening 21, the voltage is applied between the first electrode 60 and the second electrode 80 respectively in correspondence to the pressure generation chamber 12 in accordance with a recording signal from the driving circuit 120, and the elastic film 50, the insulator film 55, the first electrode 60 and the piezoelectric layer 70 are deformed in a deflection manner so that the pressure in each of the pressure generation chambers 12 increases and thus ink droplets are ejected from the nozzle opening 21.

The taper section 61 is provided in the boundary A between the active section 320 and the inactive section 330 opposite the extending section 65 of the first electrode 60 such that the width of the taper section 61 is gradually decreased toward the boundary A from the active section 320, so that the stress concentration toward the boundary A between the active section 320 and the inactive section 330 is suppressed. Similarly, the taper section 61 is also provided at the boundary B of the extending section 65 side, so that the stress concentration toward the boundary B between the active section 320 and the inactive section 330 of the extending section 65 side is suppressed.

Second Embodiment

Figure 5:
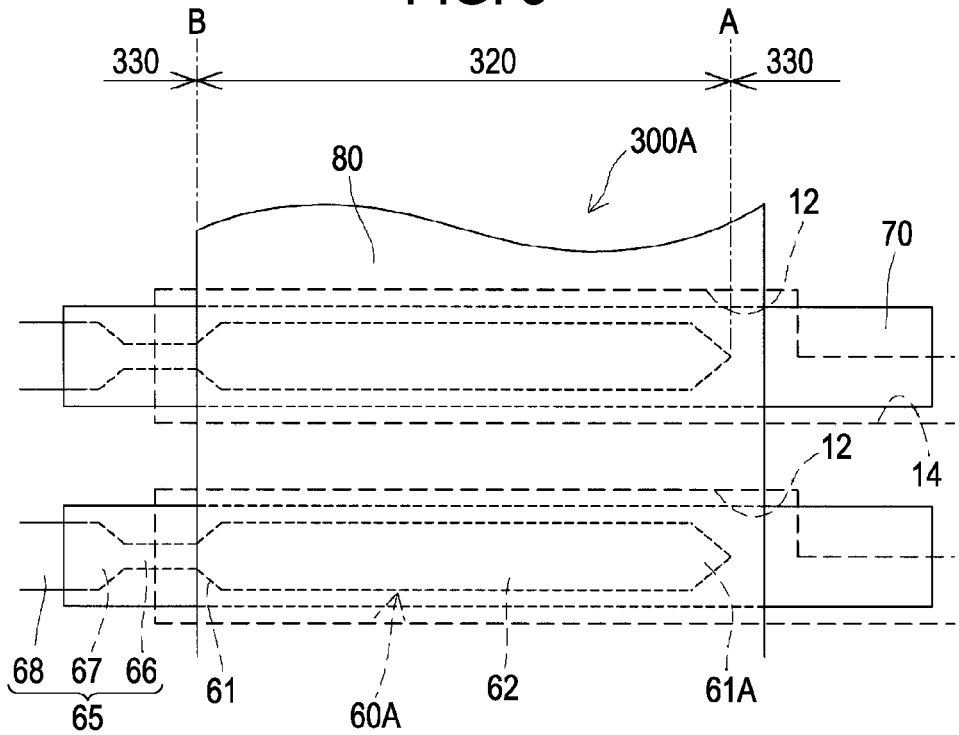
FIG. 5 is a plan view showing a recording head according to a second embodiment.

FIG. 5 is an enlarged plan view showing main parts of an ink jet type recording head that is an example of the liquid ejecting head according to a second embodiment of the invention. Also, the constituent elements similar to those of the first embodiment are represented by similar reference numbers thereof, and the repetition of the description will be avoided.

As shown in FIG. 5, the piezoelectric element 300A of the second embodiment has a first electrode 60A, the piezoelectric layer 70 and the second electrode 80.

The first electrode 60A has a straight-line section 62 provided at the center, a taper section 61A that is provided in a boundary A of the ink supply channel 14 side between the active section 320 and an inactive section 330 such that the width of the taper section 61A is gradually decreased toward the boundary A from the active section 320. Thus, the taper section 61A of the first electrode 60A is provided further inside (the pressure generation chamber 12 side) than the end portion of the second electrode 80 in the longitudinal direction of the pressure generation chamber 12. Accordingly, the end portion of the ink supply channel 14 side in the longitudinal direction (the longitudinal direction of the pressure generation section 12) of the active section 320 of the piezoelectric element 300 is defined by the taper section 61A of the first electrode 60A.

Similarly to the above-described first embodiment, the first electrode 60A has the taper section 61 that is provided in the boundary B between the active section 320 and the inactive section 330 opposite to the ink supply channel 14 side such that the width of the taper section 61 is gradually decreased toward the boundary B from the active section 320. Furthermore, the first electrode 60A has the extending section 65 that is extended to the outside of the piezoelectric layer 70 in the side opposite to the ink supply channel 14. Similarly to the above-described first embodiment, the extending section 65 has the narrow width section 66, the gradual increasing section 67 and the drawn-out section 68.

The taper section 61A is provided in the first electrode 60A so that the stress concentration in the boundary A between the active section 320 and the inactive section 330 of the ink supply channel 14 side is suppressed, and the occurrence of damage such as cracking or the like can be decreased. Also, similarly to the above-described first embodiment, the taper section 61 is also provided in the boundary B of the extending section 65 side of the first electrode 60A, so that the stress concentration in the boundary B between the active section 320 and the inactive section 330 of the extending section 65 side is suppressed, and the occurrence of damage such as cracking or the like can be decreased.

As in the first embodiment, when the end portion of the ink supply channel 14 side of the first electrode 60A is provided further inside than the end portion of the second electrode 80, the area of the active section 320 (the excluded volume of the pressure generation chamber 12) becomes small. Thus, preferably, the end portion of the second electrode 80 moves as near as possible to the end portion side of the pressure generation chamber 12 in a longitudinal direction and the end portion of the first electrode 60 also moves as near as possible to the second electrode 80.

Third Embodiment

Figure 6:
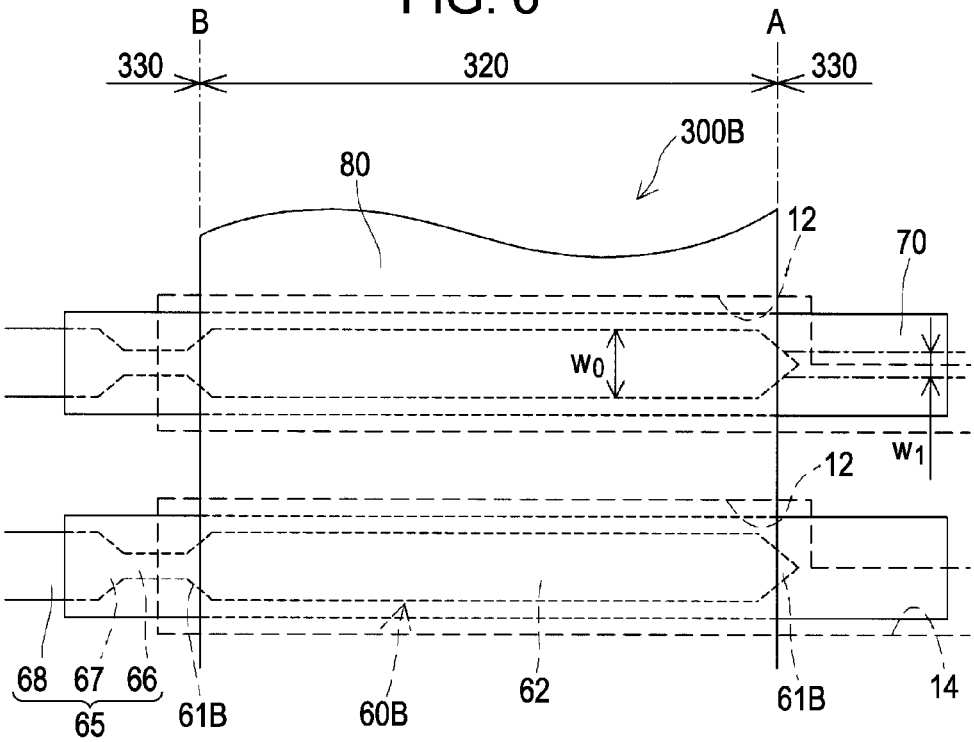
FIG. 6 is a plan view of a recording head according to a third embodiment.

FIG. 6 is an enlarged plan view showing main parts of an ink jet type recording head that is an example of the liquid ejecting head according to a third embodiment of the invention. Also, the constituent elements similar to those of the first embodiment are represented by similar reference numbers thereof, and the repetition of the description will be avoided.

As shown in FIG. 6, a piezoelectric element 300B of the third embodiment has a first electrode 60B, the piezoelectric layer 70 and the second electrode 80.

The first electrode 60B of the third embodiment is arranged so as to be at further outside than the end portion of the second electrode 80 of the pressure generation chamber 12 in the longitudinal direction. Thus, the end portion of the active section 320 in the longitudinal direction (the longitudinal direction of the pressure generation chamber 12) is defined by the end portion of the second electrode 80.

The first electrode 60B has the straight-line section 62 that is provided in the center and a taper section 61B that is provided in the boundary A of the ink supply channel 14 side between the active section 320 and the inactive section 330 such that the width of the taper section 61B is gradually decreased toward the boundary A from the active section 320. The taper section 61B is provided so as to face the end portion of the second electrode 80. In other words, the taper section 61B is provided such that the width of the taper section 61B is gradually decreased from the active section 320 that is the area facing the second electrode 80 to the inactive section 330 which is the area not facing the second electrode 80. Thus, preferably, width $w_1$ of the boundary A of the taper section 61B is 50% or less of the width $w_0$ of the center of the straight-line section 62, more preferably, 25% to 50%. Thus, the width $w_1$ of the boundary A is defined in this manner so that suitable stress dispersion can be reliably performed by the taper section 61B of the boundary.

Similarly, the first electrode 60B has the taper section 61B that is provided at the boundary B between the active section 320 and the inactive section 330 opposite to the ink supply channel 14, such that the width of the taper section 61B is gradually decreased toward the boundary B from the active section 320. The taper section 61B of the boundary B side is also provided to the inactive section 330 from the active section 320, similar to the taper section 61B that is provided at the boundary A of the ink supply channel 14 side. In other words, the taper section 61B of the extending section 65 side is arranged so as to face the end portion of the second electrode 80. Also, the extending section 65 extends to the outside of the piezoelectric layer 70 from the taper section 61B.

In the piezoelectric element 300B, the taper section 61B is provided in the active section 320 and the inactive section 330, in other words, in the boundaries A and B between the active section 320 and the inactive section 330. Thus, because the first electrode 60B is present even in the inactive section 330 at the boundary A side, the boundary A between the active section 320 and the inactive section 330 does not conform to the boundary of which the stiffness is rapidly changed, the stiffness of the piezoelectric element 300 is not rapidly changed in the boundary A, and then the stiffness can be steadily changed. In other words, the stiffness of the inactive section 330 becomes gradually higher toward the active section 320 by the taper section 61B. In addition, the boundary between the active section 320 and the inactive section 330 is not only the boundary of the driving area but also the boundary A of which the stiffness is rapidly changed by whether the first electrode 60B is present or not, so that when the boundary A between the active section 320 and the inactive section 330 and the boundary in which the stiffness is rapidly changed are the same position, the stress can be easily concentrated. In the embodiment, the taper section 61B is provided to the inactive section 330 from the active section 320 so that the boundaries in which the stiffness is rapidly changed and the boundary A between the active section 320 and the inactive section 330 are positioned at different positions, the stress can be further effectively dispersed.

Because the piezoelectric layer 70 formed on the end surface of the taper section 61B have crystallization worse than the piezoelectric layer 70 that is formed on the horizontal surface, the stress concentration can be suppressed by even the decrease of the displacement amount caused by the degradation of the crystallization of the piezoelectric layer 70 on the taper section 61B.

In the embodiment, the same taper sections 61B are provided on the ink supply channel 14 side and the extending section 65 side. Thus, two taper sections 61B can be formed symmetrically in the longitudinal direction in the area, which becomes the active section 320.

Fourth Embodiment

Figure 7:
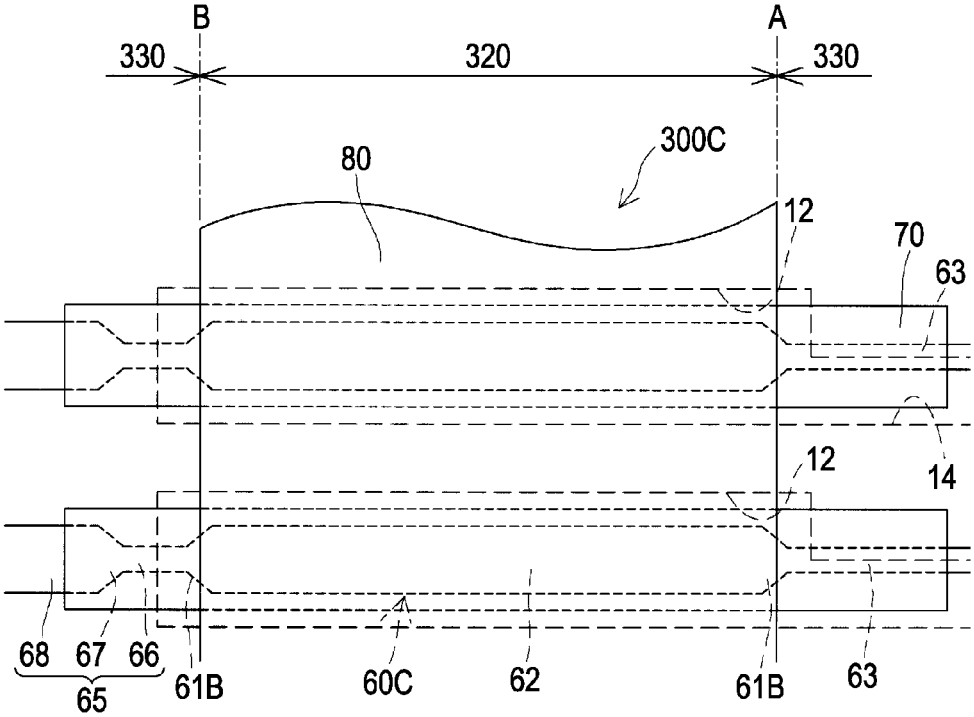
FIG. 7 is a plan view of a recording head according to a fourth embodiment.

FIG. 7 is an enlarged plan view showing main parts of an ink jet type recording head that is an example of the liquid ejecting head according to a fourth embodiment of the invention. Also, the constituent elements similar to those of the above-described embodiment are represented by similar reference numbers thereof, and the repetition of the description will be avoided.

As shown in FIG. 7, a piezoelectric element 300C has a first electrode 60C, the piezoelectric layer 70 and the second electrode 80.

The first electrode 60C includes a straight-line section 62 that is provided on the active section 320, the taper section 61B that is provided on both end portions in a longitudinal direction and an extending section 63 that is continuously provided to the taper section 61B of the ink supply channel 14 side. In other words, the other constitution is the same as that of the above-described third embodiment except the extending section 63 is provided on the first electrode 60B.

Even the piezoelectric element 300C can exhibit the same effect as that of the above-described third embodiment is present.

Fifth Embodiment

Figure 8:
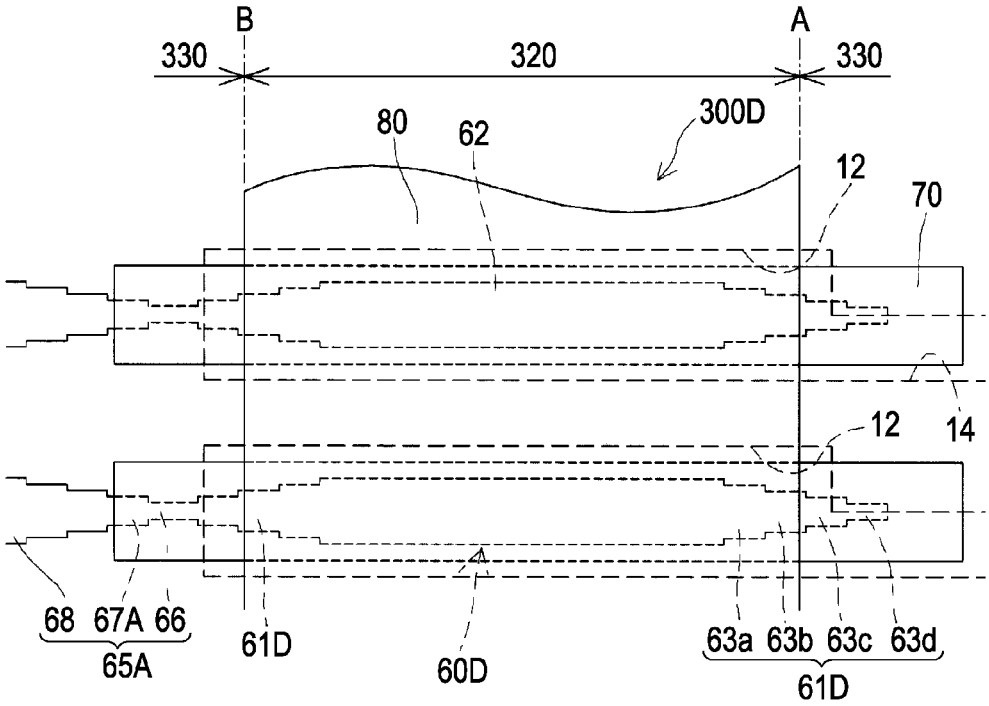
FIG. 8 is a plan view of a recording head according to a fifth embodiment.

FIG. 8 is an enlarged plan view showing main parts of an ink jet type recording head that is an example of the liquid ejecting head according to a fifth embodiment of the invention. Also, the constituent elements similar to those of the above-described first embodiment are represented by similar reference numbers thereof, and the repetition of the description will be avoided.

As shown in FIG. 8, a piezoelectric element 300D includes a first electrode 60D, the piezoelectric layer 70 and the second electrode 80.

The first electrode 60D has a straight-line section 62 that is provided at the center, and a taper section 61D that is provided in the boundary A of the ink supply channel 14 side between the active section 320 and the inactive section 330 such that the width of the taper section 61D is gradually decreased toward the boundary A from the active section 320 in a step-like manner (step shape). Also, the taper section 61D is provided in the boundary between the active section 320 and the inactive section 330. Specifically, the taper section 61D includes a first narrow width section 63*a* narrower than the straight-line section 62, a second narrow width section 63*b* narrower than the first narrow width section 63*a*, a third narrow width section 63*c* narrower than the second narrow width section 63*b*, and a fourth narrow width section 63*d* narrower than the third narrow width section 63*c*. The taper section 61D is provided, such that the width is gradually decreased from the first narrow width section to the fourth narrow width section 63*a* to 63*d*.

The first electrode 60D has a taper section 61D that is provided in the boundary B opposite to the ink supply channel 14 such that the width of the taper section 61D is gradually decreased toward the boundary B from the active section 320.

Also, the first electrode 60D has an extending section 65A opposite to the ink supply channel 14. The extending section 65A of the embodiment includes the narrow width section 66, a gradual increasing section 67A that is gradually increased in the step-like manner (step shape) similar to that of the taper section 61D, and the drawn-out section 68.

Similar to the above-described third embodiment, in the piezoelectric element 300D in which the taper section 61D is provided, the stress concentration at the boundary A between the active section 320 and the inactive section 330 of the piezoelectric element 300D is also decreased by the taper section 61D so that the risk of damage such as cracking and the like can be suppressed. The taper section 61D is provided in the boundary B of the extending section 65A side so that the stress concentration at the boundary B is decreased and the risk of damage such as cracking and the like can be suppressed.

Also, in the embodiment, the gradual increasing section 67A of the extending section 65A is gradually increased in the step-like manner (step shape) similar to that of the taper section 61D, but the invention is not specifically limited to the description and the gradual increasing section 67A may be formed of which the width is gradually increased in a taper shape as in the first embodiment.

Sixth Embodiment

Figure 9:
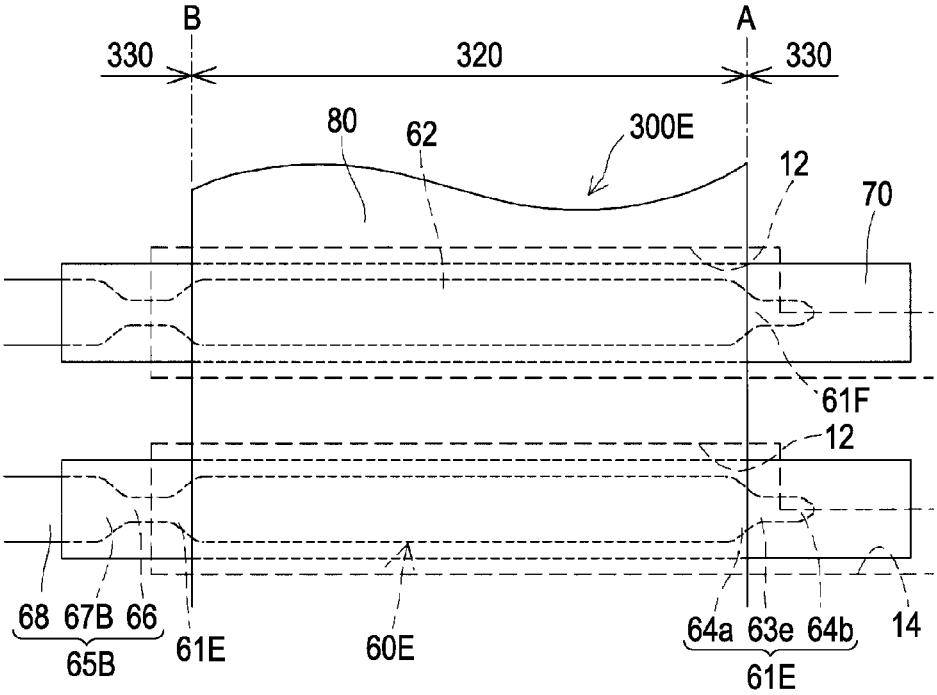
FIG. 9 is a plan view of a recording head according to a sixth embodiment.

FIG. 9 is an enlarged plan view showing an main parts of the ink jet type liquid ejecting head that is an example of the liquid ejecting head according to a sixth embodiment. Also, the constituent elements similar to those of the above-described embodiment are represented by similar reference numbers thereof, and the repetition of the description will be avoided.

As shown in FIG. 9, the piezoelectric element 300E of the embodiment includes a first electrode 60E, the piezoelectric layer 70 and the second electrode 80.

The first electrode 60E has a straight-line section 62 that is provided at the center, and a taper section 61E that is provided in the boundary A of the ink supply channel 14 side between the active section 320 and the inactive section 330 such that the width of the taper section 61E is gradually decreased toward the boundary A from the active section 320. The taper section 61E is provided in the boundary A between the active section 320 and the inactive section 330. Specifically, the taper section 61E includes a fifth narrow width section 63*e* which has the width narrower than that of the straight-line section 62, a first taper section 64*a* that is continuous to the straight-line section 62 and the fifth narrow width section 63*e*, a second taper section 64*b* that is provided in a side opposite to the first taper section 64*a* of the fifth narrow width section 63*e* and the width thereof is gradually decreased more than that of the fifth narrow width section 63*e*. In other words, the taper section 61E comprises the first taper section 64*a*, the fifth narrow width section 63*e* and the second taper section 64*b*. Also, the side surface of the boundary between the straight-line section 62 and the first taper section 64*a* is provided to be curved shape with an angular section removed(R chamfered). Similarly, the side surface of the boundary between the first taper section 64*a* and the fifth narrow width section 63*e* is R chamfered and the side surface of the boundary between the fifth narrow width section 63*e* and the second taper section 64*b* is also R chamfered. Furthermore, similarly, the tip end of the second taper section 64*b* is also R chamfered and the side surface has a curved shape with the all the angular portions removed to the taper section 61E from the straight-line section 62.

With the above configurations, the stress concentration toward the boundary A between the active section 320 and the inactive section 330 of the piezoelectric element 300 can be decreased by the taper section 61E and the side surface of the taper section 61E is a curved shape of which angular portions are removed so that stress concentration toward the portion where the width thereof is rapidly changed, can be further suppressed.

As shown in FIG. 9, the first electrode 60E has the taper section 61E that is provided in the boundary B between the active section 320 and the inactive section 330 opposite to the ink supply channel 14 such that the width of the taper section 61E is gradually decreased toward the boundary B from the active section 320. In addition, an extending section 65B is continuously provided in the taper section 61E of the boundary B. The extending section 65B includes the narrow width section 66, a gradual increasing section 67B of which the side surface has a curved shape with the angular portions removed (R chamfered), and the drawn-out section 68. Accordingly, the stress concentration in the boundary B between the active section 320 and the inactive section 330 on the extending section 65B side of the piezoelectric element 300 can be suppressed.

Other Embodiments

Each of embodiments of the invention is described, but the basic configurations of the invention are not limited to the above description. For example, in the above-described first to sixth embodiments, taper sections 61 to 61E are provided even in the end portion of the active section 320 opposite to the ink supply channel 14 of the first electrodes 60 to 60E, but because this section is provided until the first electrodes 60 to 60E reaches to the inactive section 330 from the active section 320 by the extending section 65 to 65B, the change of stiffness due to whether the first electrodes 60 to 60E are present or not, is small. Accordingly, the taper sections 61 to 61E may be provided to at least in the end portion opposite to the extending sections 65 to 65B, and the taper section may not be provided at the extending sections 65 to 65B side. Of course, the taper sections of the extending sections 65 to 65B side may be a combination different from the taper sections 61 to 61E of the ink supply channel 14 opposite to the extending sections 65 to 65B.

Figure 10A:
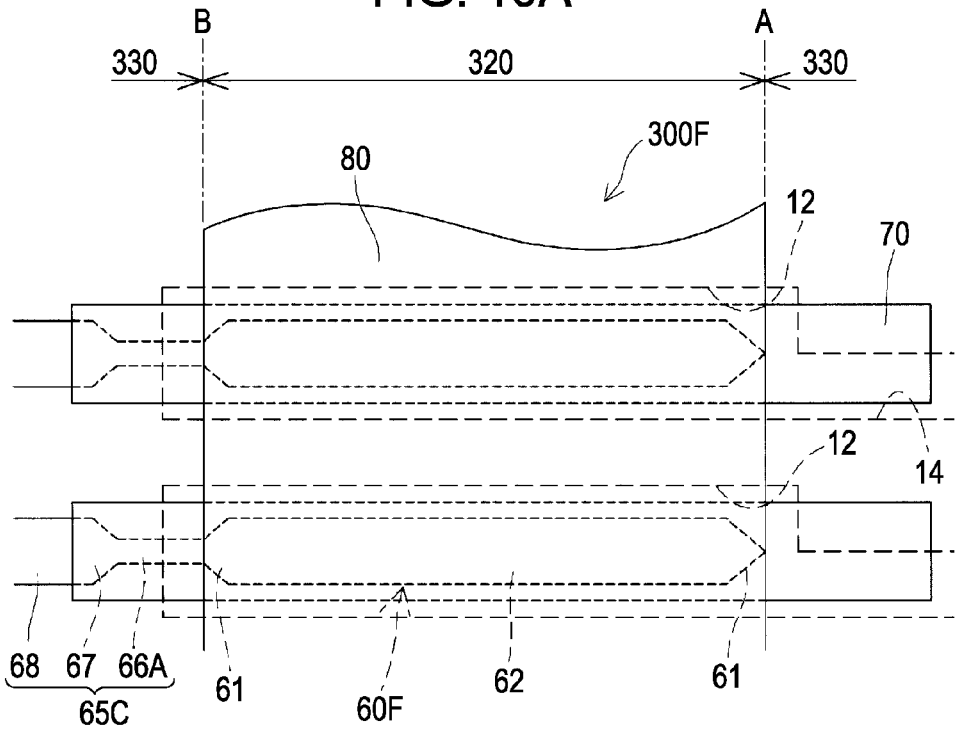
FIGS. 10A and 10B are a plan view and an enlarged sectional view of main parts showing a recording head according to another embodiment.
Figure 10B:
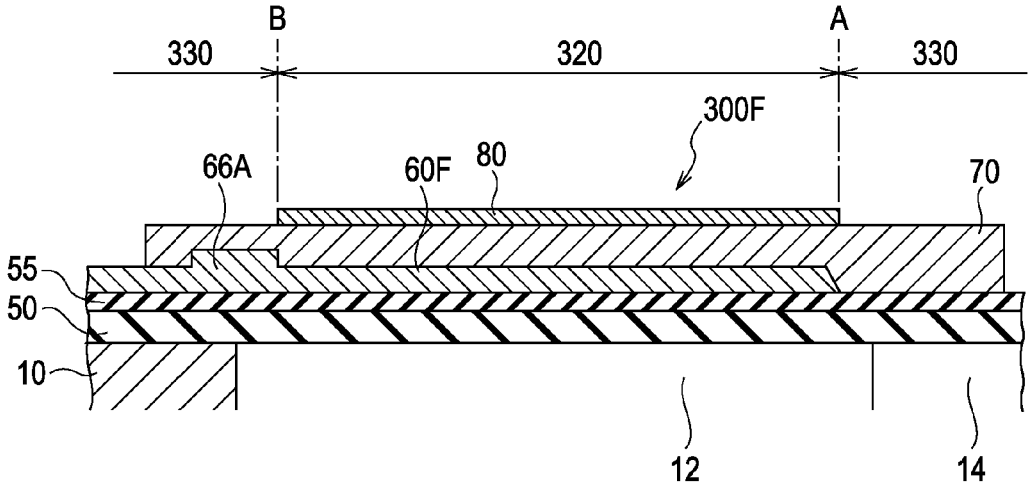

Also, in the above-described first to the sixth embodiments, the first electrodes 60 to 60E are formed in the substantially same thickness, but the invention is not specifically limited to that. A modified example of the above-described first embodiment is shown in FIGS. 10A and 10B. FIGS. 10A and 10B are a plan view and sectional view showing the ink jet type recording head according to other embodiment of the invention.

As shown in FIGS. 10A and 10B, a piezoelectric element 300F includes a first electrode 60F, a piezoelectric layer 70 and a second electrode 80. The first electrode 60F includes a straight-line section 62 and a taper section 61 that are provided in the boundaries A and B. Also, the first electrode 60F is provided with an extending section 65C that is continuously to the taper section 61 at the boundary B side. The extending section 65C includes a narrow width section 66A, the gradual increasing section 67 and the drawn-out section 68, and the narrow width section 66A is formed thicker than other areas (mainly, the straight-line section 62 of the center of the active section 320). As described above, since the narrow width section 66A is formed thicker than other areas, electric resistance of the narrow width section 66A is dropped so that voltage that is applied to the piezoelectric element 300F can be prevented from dropping by the narrow width section 66A. Of course, areas except the narrow width section 66A, for example, the taper section 61 and the gradual increasing section 67 or the like which are continuously to the narrow width section 66A, may be formed with a similar thickness to that of the narrow width section 66A. However, when the thickness of the straight-line section 62 is thick, the stiffness of the straight-line section 62 is increased, and there are concerns that displacement of the piezoelectric element 300 will be hindered, so that it is preferable if the first electrode 60 of the active section 320 is formed as thin as possible.

In the above-described embodiments, the silicon monocrystal substrate is exemplified as the flow channel forming substrate 10, but the invention is not specifically limited to that, and for example, SOI substrate, glass material and the like may also be used.

In the above-described embodiments, the second electrodes 80 of piezoelectric elements 300 to 300F are exemplified which are continuous between adjacent pressure generation chambers 12, but the invention is not specifically limited to those. The meaning that the second electrodes 80 are provided continuously to the plurality of pressure generation chambers 12 includes that the case where the second electrodes 80 is provided in a so-called comb teeth shape, that is, the second electrode 80 are separated between adjacent pressure generation chambers 12 and continuously provided in the outside between adjacent pressure generation chambers 12. Now, such an example is shown in FIG. 11. FIG. 11 is an enlarged plan view showing main parts of an ink jet type recording head according to other embodiment of the invention. As shown in FIG. 11, a piezoelectric element 300G has the first electrode 60A, the piezoelectric layer 70 and a second electrode 80A. The second electrode 80A is separated between adjacent pressure generation chambers 12 and continuous to the outside between adjacent pressure generation chambers 12, provided in so-called comb teeth shape. In the piezoelectric element 300G, an end portion of the ink supply channel 14 of the active section 320 in the longitudinal direction, in other words, boundary A is defined by the end portion (the taper section 61A) of the first electrode 60A. Also, an end portion of the active section 320 in the lateral direction is defined by the width of the first electrode 60A or may also be defined by the width of the second electrode 80A. In the case, similarly to the above-described first embodiment, the taper section 61A, the taper section 61 or the like are provided in the first electrode 60A so that the stress concentration in the boundary between the active section 320 and the inactive section 330 can be suppressed.

Also, in the above-described example, even though a protective film having wet resistance is not provided on the piezoelectric elements 300 to 300G, because one end portion of the pressure generation chambers 12 of the first electrodes 60 to 60F in longitudinal direction is covered with the piezoelectric layer 70, current between the first electrodes 60 to 60F and the second electrodes 80 and 80A does not leak, and thus the risk of damage to the piezoelectric elements 300 to 300G can be suppressed. Also, the other end portion of the pressure generation chambers 12 of the first electrodes 60 to 60F in a longitudinal direction is not covered with the piezoelectric layer 70, but because a distance is present between the first electrodes 60 to 60F and the second electrodes 80 and 80A, there is no influence particularly. Of course, protective films having wet resistance are provided on the piezoelectric elements 300 to 300G so that the piezoelectric elements 300 to 300G can be reliably protected, but by not providing the protective film as is the piezoelectric elements 300 to 300G of the above-described examples, the protective films do not hinder the displacement of the piezoelectric elements 300 to 300G and large displacement thereof can be obtained.

In the above-described embodiments, the piezoelectric layer 70 is separated in each of pressure generation chambers 12, but the invention is not limited to that. For example, the piezoelectric layer 70 may be continuously provided along the arrangement direction of the pressure generation chamber 12.

Figure 12:
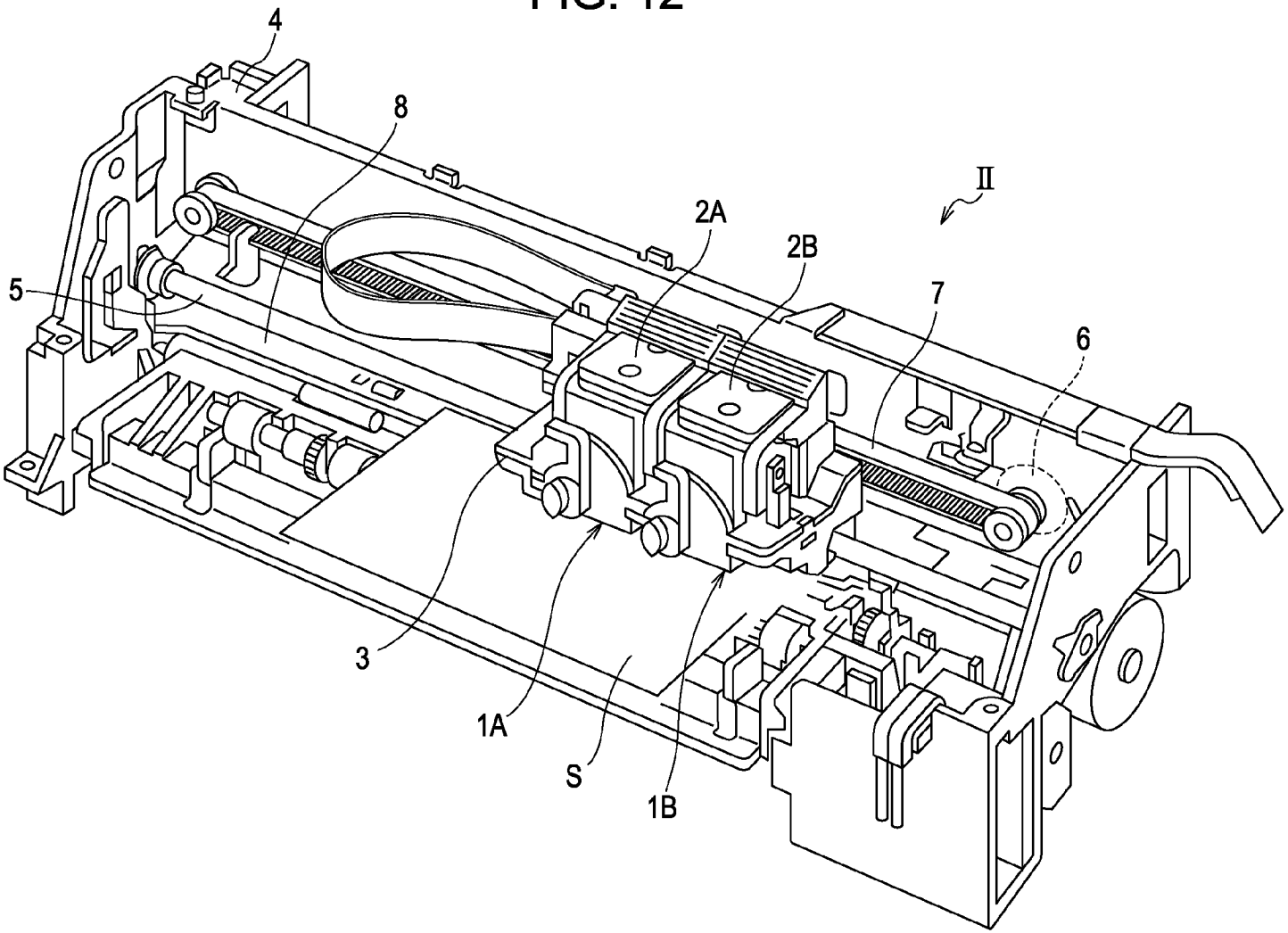
FIG. 12 is a schematic view of a recording apparatus according to an embodiment.

The ink jet type recording head of each of embodiments forms a part of a recording head unit having an ink flow channel linking with an ink cartridge or the like, and is mounted on the ink jet type recording apparatus. FIG. 12 is a schematic view showing an example of the ink jet type recording apparatus.

In an ink jet type recording apparatus II shown in FIG. 12, cartridges 2A and 2B constituting an ink supply unit are detachably provided in recording head units 1A and 1B having the ink jet type recording head I. A carriage 3 on which the recording head units 1A and 1B are mounted, is provided to be axially movable along a carriage shaft 5 attached to the apparatus main body 4. Recording head units 1A and 1B eject, for example, a black ink composition and a color ink composition, respectively.

A driving force of a driving motor 6 is transmitted to the carriage 3 through a plurality of gears (not shown) and a timing belt 7, and the carriage 3 with the recording head units 1A and 1B mounted thereon moves along the carriage shaft 5. A platen 8 is provided in the apparatus main body 4 along the carriage shaft 5. A recording sheet S, which is a recording medium such as paper or the like, fed by a sheet feed roller (not shown) or the like, is wound and transported on the platen 8.

Also, in the above-described ink jet type recording apparatus II, the ink jet type recording head I (head units 1A and 1B) being mounted on the carriage 3 and moving in the main scanning direction is exemplified, but the invention is not limited to that. For example, the ink jet type recording head I is fixed and only the recording sheet S such as paper or the like moves in a sub-scanning direction so that the printing is performed, and to so-called line type recording apparatus, the invention may also be applied.

In the above-described embodiments, the ink jet type recording head has been described as an example of a liquid ejecting head, but the invention is widely intended for liquid ejecting heads in general. The invention may be of course, applied to a liquid ejecting head ejecting a liquid other than ink. Other examples of the liquid ejecting heads include, for example, various recording heads used for an image recording apparatus, such as a printer or the like, a color material ejecting head that is used to manufacture a color filter of a liquid crystal display or the like, an electrode material ejecting head that is used to form an electrode of an organic EL display, an FED (Field Emission Display), or the like, a bioorganic ejecting head that is used to manufacture a bio-chip, and the like.

What is claimed is:

1. A liquid ejecting head comprising:

a flow channel forming substrate having pressure generation chambers communicating with a nozzle opening; and a piezoelectric element having a first electrode, a piezoelectric layer provided above the first electrode and a second electrode provided above the piezoelectric layer, wherein in an direction intersecting with the arrangement direction of the pressure generation chamber, in boundaries between an active section that is a substantial driving section and inactive sections that are not a substantial driving section of the piezoelectric layer, the first electrode includes a taper section of which a width in a planar direction that the piezoelectric layer extends is gradually decreased toward the boundary from the active section side such that the taper section can decrease an area to which an electric field of the first electrode per unit area of the piezoelectric body layer is applied, wherein the second electrode does not extend beyond that active section.

2. The liquid ejecting head according to claim 1, wherein the taper section is provided such that the width thereof is gradually decreased in the active section and the inactive section.

3. The liquid ejecting head according to claim 1, wherein the side surface of the taper section is provided to form an angle of 45° or less with respect to the side surface of a straight-line section of a center portion of the first electrode.

4. The liquid ejecting head according to claim 1, wherein in the direction intersecting with the arrangement direction of the pressure generation chamber, an extending section extends to the outside of the piezoelectric layer at one end portion side of the first electrode, and the taper section is provided in at least one boundary opposite to the extending section of boundaries between the active section and the inactive section of the piezoelectric layer.

5. The liquid ejecting head according to claim 4, wherein the taper section is also provided in the boundary of the extending section side of the boundaries between the active section and the inactive section of the piezoelectric layer.

6. The liquid ejecting head according to claim 5, wherein the taper section is provided so as to be symmetrical in the longitudinal direction at the area in which the active section is formed.

7. The liquid ejecting head according to claim 4, wherein an area, of which the width is narrower than that of the straight-line section that is provided on the center portion of the first electrode of the extending section, has a thickness thicker than that of the straight-line section.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

* * * * *